US006950069B2

(12) United States Patent
Gaucher et al.

(10) Patent No.: US 6,950,069 B2
(45) Date of Patent: Sep. 27, 2005

(54) INTEGRATED TRI-BAND ANTENNA FOR LAPTOP APPLICATIONS

(75) Inventors: Brian Paul Gaucher, Brookfield, CT (US); Duixian Liu, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/318,816

(22) Filed: Dec. 13, 2002

(65) Prior Publication Data

US 2004/0113848 A1 Jun. 17, 2004

(51) Int. Cl.[7] ..... H01Q 1/24
(52) U.S. Cl. ..... 343/702; 343/700 MS
(58) Field of Search ..... 343/767, 829, 343/846, 702, 700 MS

(56) References Cited

U.S. PATENT DOCUMENTS 5,808,586 A * 9/1998 Phillips et al. ..... 343/895
6,339,400 B1 * 1/2002 Flint et al. ..... 343/702
6,642,892 B2 * 11/2003 Masaki et al. ..... 343/702
6,650,294 B2 * 11/2003 Ying et al. ..... 343/700 MS
6,724,348 B2 * 4/2004 Fang ..... 343/702
2002/0190905 A1 * 12/2002 Flint et al. ..... 343/702

OTHER PUBLICATIONS

U.S. Appl. No. 09/866,974, filed May 29, 2001, entitled An Integrated Antenna for Laptop Applications.

* cited by examiner

*Primary Examiner*—Tho Phan
(74) *Attorney, Agent, or Firm*—Frank V. DeRosa; F. Chau & Associates, LLC

(57) ABSTRACT

Integrated (embedded) tri-band antennas for use with portable devices such as laptop computers. In one aspect, an integrated tri-band antenna for a portable device comprises a first element having a resonant frequency in a first frequency band, a second element having a resonant frequency in a second frequency band, a third element having a resonant frequency in a third frequency band, and a ground element for grounding the first, second and third elements. The first, second and third elements and ground element may be metallic elements formed on a PCB (printed circuit board), wherein the first element is connected to a signal feed, and wherein the PCB is mounted to a metallic support frame of a display unit of the portable device.

25 Claims, 13 Drawing Sheets

2.40 GHz, 0.26/5.64 dBi
2.45 GHz, 0.25/6.00 dBi
2.50 GHz, 0.03/5.72 dBi

INTEGRATED TRI-BAND ANTENNA FOR LAPTOP APPLICATIONS

TECHNICAL FIELD

The present invention relates generally to antennas for use with portable devices. More specifically, the invention relates to integrated (embedded) tri-band antennas for use with portable computers (laptops).

BACKGROUND

To provide wireless connectivity between a portable processing device (e.g., laptop computer) and other computers (laptops, servers, etc.), peripherals (e.g., printers, mouse, keyboard, etc.) or communication devices (modem, smart phones, etc.) it is necessary to equip the portable device with an antenna. For example, with portable laptop computers, an antenna may be located either external to the device or integrated (embedded) within the device (e.g., embedded in the display unit).

For example, FIG. 1 is a diagram illustrating various embodiments for providing external antennas for a laptop computer. For instance, an antenna (1) can be located at the top of a display unit (10) of the laptop. Alternatively, an antenna (2) can be located on a PC card (12). The laptop computer will provide optimum wireless connection performance when the antenna is mounted on the top of the display due to the very good RF (radio frequency) clearance. There are disadvantages, however, associated with laptop designs with external antennas including, for example, high manufacture costs, possible reduction of the strength of the antenna (e.g., for a PC card antenna (2)), susceptibility of damage, and the effects on the appearance of the laptop due to the antenna.

Other conventional laptop antenna designs include embedded designs wherein one or more antennas are integrally built (embedded antenna) within a laptop. For example, FIG. 2 illustrates conventional embedded antenna implementations, wherein one or more antennas (3, 4, 5) (e.g., whip-like or slot embedded antenna) are embedded in a laptop display (11). In one conventional embodiment, two antennas are typically used (although applications implementing one antenna are possible). In particular, two embedded antennas (3, 4) can be placed on the left and right edges of the display (11). The use of two antennas (as opposed to one antenna) will reduce the blockage caused by the display in some directions and provide space diversity to the wireless communication system.

In another conventional configuration, one antenna (3 or 4) is disposed on one side of the display (11) and a second antenna (5) is disposed in an upper portion of the display (11). This antenna configuration may also provide antenna polarization diversity depending on the antenna design used.

Although embedded antenna designs can overcome some of the above-mentioned disadvantages associated with external antenna designs (e.g., less susceptible to damage), embedded antenna designs typically do not perform as well as external antennas. To improve the performance of an embedded antenna, the antenna is preferably disposed at a certain distance from any metal component of a laptop. For example, depending on the laptop design and the antenna type used, the distance between the antenna and any metal component should be at least 10 mm. Another disadvantage associated with embedded antenna designs is that the size of the laptop must be increased to accommodate antenna placement, especially when two or more antennas are used (as shown in FIG. 2).

U.S. Pat. No. 6,339,400, issued to Flint et al. on Jan. 15, 2002, entitled "Integrated Antenna For Laptop Applications", which is commonly assigned and incorporated herein by reference, discloses various embedded antenna designs, which provide improvements over conventional embedded antenna designs. More specifically, the patent describes various embodiments wherein embedded antennas are (i) disposed on edges of the laptop display wherein a metal frame of the display unit is used as a ground plane for the antennas, and/or (ii) formed on a conductive RF shielding foil disposed on the back of the display, wherein coaxial transmission lines are used to feed the antennas (e.g., the center conductors are coupled to the radiating element of the antenna and the outer (ground connector) is coupled to the metal rim of the display unit). Advantageously, these integrated designs support many antenna types, such as slot antennas, inverted-F antenna and notch antennas, and provide many advantages such as smaller antenna size, low manufacturing costs, compatibility with standard industrial laptop/display architectures, and reliable performance.

Continuing advances in wireless communications technology has lead to significant interest in development and implementation of wireless computer applications. For instance, spontaneous (ad hoc) wireless network connectivity can be implemented using the currently emerging "Bluetooth" networking protocol. Briefly, Bluetooth is a protocol for providing short-range wireless radio links between Bluetooth-enabled devices (such as smartphones, cellular phone, pagers, PDAs, laptop computers, mobile units, etc.). Bluetooth enabled devices comprise a small, high performance, low-power, integrated radio transceiver chip comprising a baseband controller for processing input/output baseband signals using a frequency-hop spread-spectrum system, as well as a modulator/demodulator for modulating/demodulating a carrier frequency in the ISM (industrial-scientific-medical) band at 2.4 GHz.

Currently, the 2.4 GHz ISM band is widely used in wireless network connectivity. By way of example, many laptop computers incorporate Bluetooth technology as a cable replacement between portable and/or fixed electronic devices and IEEE 802.11b technology for WLAN (wireless local area network). If an 802.11b device is used, the 2.4 GHz band can provide up to 11 Mbps data rate. For much higher data rates, the 5 GHz U-NII (unlicensed national information infrastructure) can be used. U-NII devices operating on the 5.15–5.35 GHz frequency range can provide data rates up to 54 Mbps.

U.S. patent application Ser. No. 09/866,974, filed on May 29, 2001, entitled "An Integrated Antenna for Laptop Applications", which is commonly assigned and incorporated herein by reference, discloses various integrated dual-band antenna designs that may be used for portable processing devices (e.g., laptop computers). The integrated dual-band antennas described in the above-incorporated U.S. Ser. No. 09/866,974 provide operation in the 2.4 GHz ISM band and the 5 GHz U-NII band, for example.

To provide an even higher data rate and provide compatibility with worldwide wireless communication applications and environments, it is desirable to provide antennas that operate in the 2.4–2.5 GHz, 5.15–5.35 GHz and 5.47–5.825 GHz bands. Accordingly, there is a need for integrated tri-band antennas for portable devices that can efficiently and reliably operate in each of the above frequency bands.

SUMMARY OF THE INVENTION

The present invention is directed to tri-band antennas that are embedded within portable devices such as laptop computers. In one aspect of the invention, a tri-band antenna for a portable device (e.g., laptop computer) comprises a first element having a resonant frequency in a first frequency band, a second element having a resonant frequency in a second frequency band, and a third element having a resonant frequency in a third frequency band, wherein the first element is connected to a signal feed, wherein the second and third elements are grounded, and wherein the first, second and third elements are integrally formed within the portable device.

Preferably, the integrated tri-band antenna operates in a first frequency band of about 2.4 GHz to about 2.5 GHz, a second frequency band of about 5.15 GHz to about 5.35 GHz and a third frequency band of about 5.47 GHz to about 5.825 GHz.

In another aspect, the first and second elements comprise metal strips formed on a first side of dual-sided PCB (printed circuit board) substrate, and wherein the third element comprises a metal strip formed on second side of the PCB substrate. The PCB is preferably mounted to a metal support frame of the display unit of the portable device.

In yet another aspect of the invention, the first and second elements (and possibly the third element) are integrally formed with a metallic cover of the display unit of the portable device.

In another aspect of the invention, the first and second elements are integrally formed with an RF shielding foil of the display unit of the portable device.

These and other aspects, objects, features and advantages of the present invention will be described or become apparent from the following detailed description of preferred embodiments, which is to be read in connection with the accompanying drawings.

DETAILED DESCRIPTION OF PREFERRED EMBODIMENTS

The present invention is directed to integrated tri-band antennas that may be used with portable devices such as laptop computers. In a preferred embodiment, the present invention is an extension of the dual-band integrated antenna designs for laptop applications as disclosed in the above incorporated U.S. patent application Ser. No. 09/866,974. More specifically, a tri-band antenna design according to an embodiment of the invention comprises an additional radiating element that is electromagnetically coupled to a dual-band antenna to achieve tri-band performance, while providing space efficiency. Advantageously, the size and manufacturing costs of a tri-band antenna according to the invention is similar to that of a dual-band antenna as disclosed in U.S. patent application Ser. No. 09/866,974.

Figure 1:
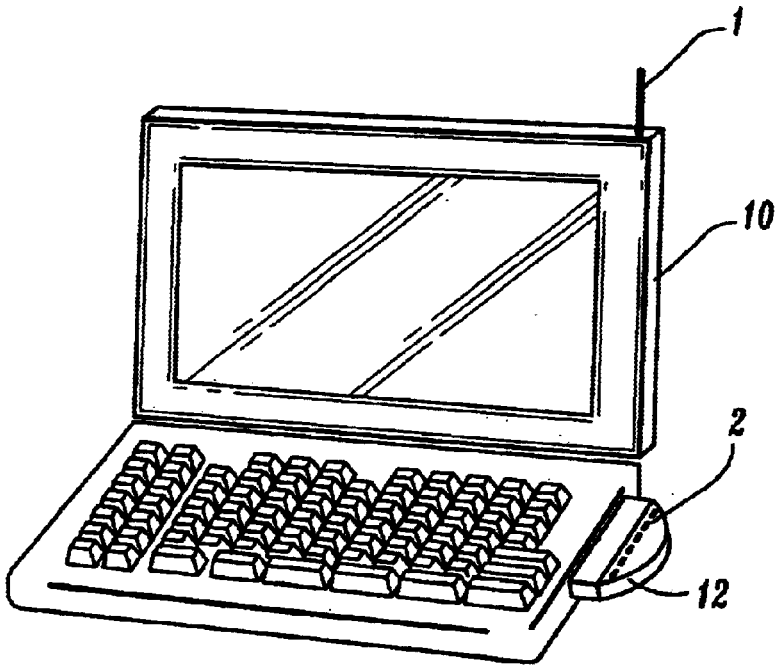
FIG. 1 (Prior Art)
FIG. 1 is a diagram illustrating various conventional embodiments of external antennas for a laptop computer.
Figure 2:
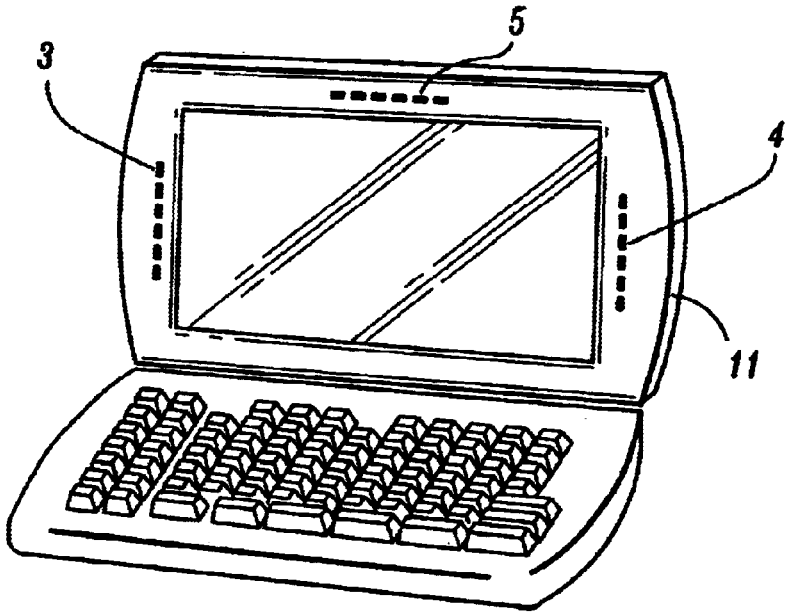
FIG. 2 (Prior Art)
FIG. 2 is a diagram illustrating various conventional embodiments of embedded (integrated) antennas for a laptop computer.
Figure 3A:
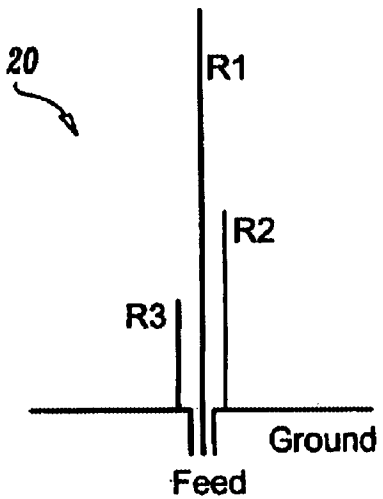
FIG. 3a (Prior Art)
FIGS. 3*a* and 3*b* are diagrams illustrating conventional tri-band antennas.
Figure 3B:
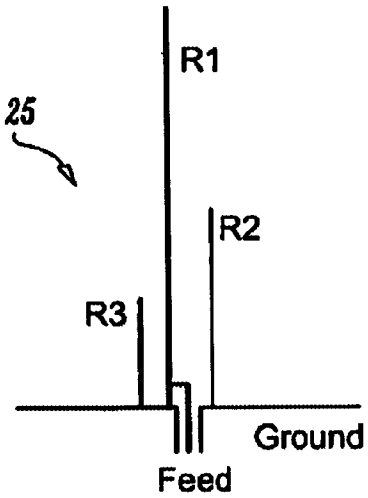
FIG. 3b (Prior Art)

FIGS. 3*a* and 3*b* illustrate various embodiments of a conventional tri-band antenna. In particular, FIG. 3(*a*) illustrates a sleeve or closely coupled tri-band antenna (20) comprising three elements R1, R2 and R3. The element R1 is the longest element and resonates at the lowest frequency F1. The element R1 is connected to signal feed (e.g., center conductor of coaxial transmission line). The element R1 is approximately one-quarter wavelength in length at the frequency F1. Essentially, the tri-band antenna (20) behaves as a quarter wavelength monopole at the low band. Further, elements R2 and R3 (wherein R3 is shorter than R2) resonate at frequencies F2 and F3 (F1<F2<F3) respectively, and are grounded. The element R2 (east) and the element R3 (west) are disposed on opposite sides of the element R1 in FIG. 3(*a*), but other orientations are possible. For example, element R2 could be disposed (north of R1) such that R2—R1—R3 forms a 90 degree angle. The input impedance for the antenna (20) is about 36 Ohms at the center of each band.

Figure 3C:
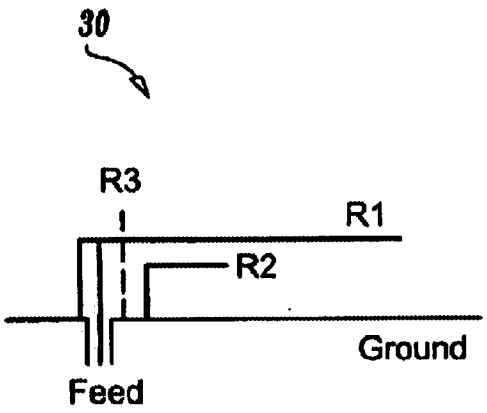
FIG. 3*c* is a diagram illustrating a tri-band antenna according to an embodiment of the invention.

FIG. 3(*b*) illustrates a tri-band antenna (25) comprising three radiating elements R1, R2 and R3. The antenna (25) is similar to the antenna (20) of FIG. 3*a*, except that all elements are grounded. This design enables improved impedance matching to 50 Ohms, which is a standard industry impedance value, depending on the connection location of the feed to element R1. The tri-band antennas of FIGS. 3(*a*) and 3(*b*) are not suitable for integration within a portable device (such as a laptop) because such designs take up a significant amount of space.

FIG. 3(*c*) is a conceptual diagram of a tri-band antenna architecture according to an embodiment of the invention. The tri-band antenna (30) is similar to the antenna (25) of FIG. 3(*b*) with respect to feeding and grounding the different elements, except that the antenna elements R1 and R2 are bent (to reduce antenna height) and the element R3 is located behind elements R1 and R2. The architecture of the tri-band antenna (30) is advantageously adapted for use with portable devices such as laptops due to the small, compact design of the antenna, as well as the reliability of operation. It is to be understood that depending on the application (e.g., operating frequencies) the elements R1, R2 and R3 of antennas (20, 25 and 30) may comprise thin metal wires or planar metal strips. Various embodiments for implementing a tri-band antenna based on the framework of FIG. 3(*c*) will be described in detail below.

It is to be appreciated that in each of the antenna frameworks shown in FIGS. 3(*a*)–(*c*), the locations of elements R2 and R3 can be switched without affecting antenna performance. It is to be further appreciated that tri-band antennas according to the invention use a single feed, which provides advantages over multi-feed antennas for cellular and WLAN applications such as cost reductions in using expensive RF connectors. In addition, tri-band antenna designs according to the invention can be used for WLAN band applications and can be extended for use in dual-band or tri-band cellular applications.

Figure 4:
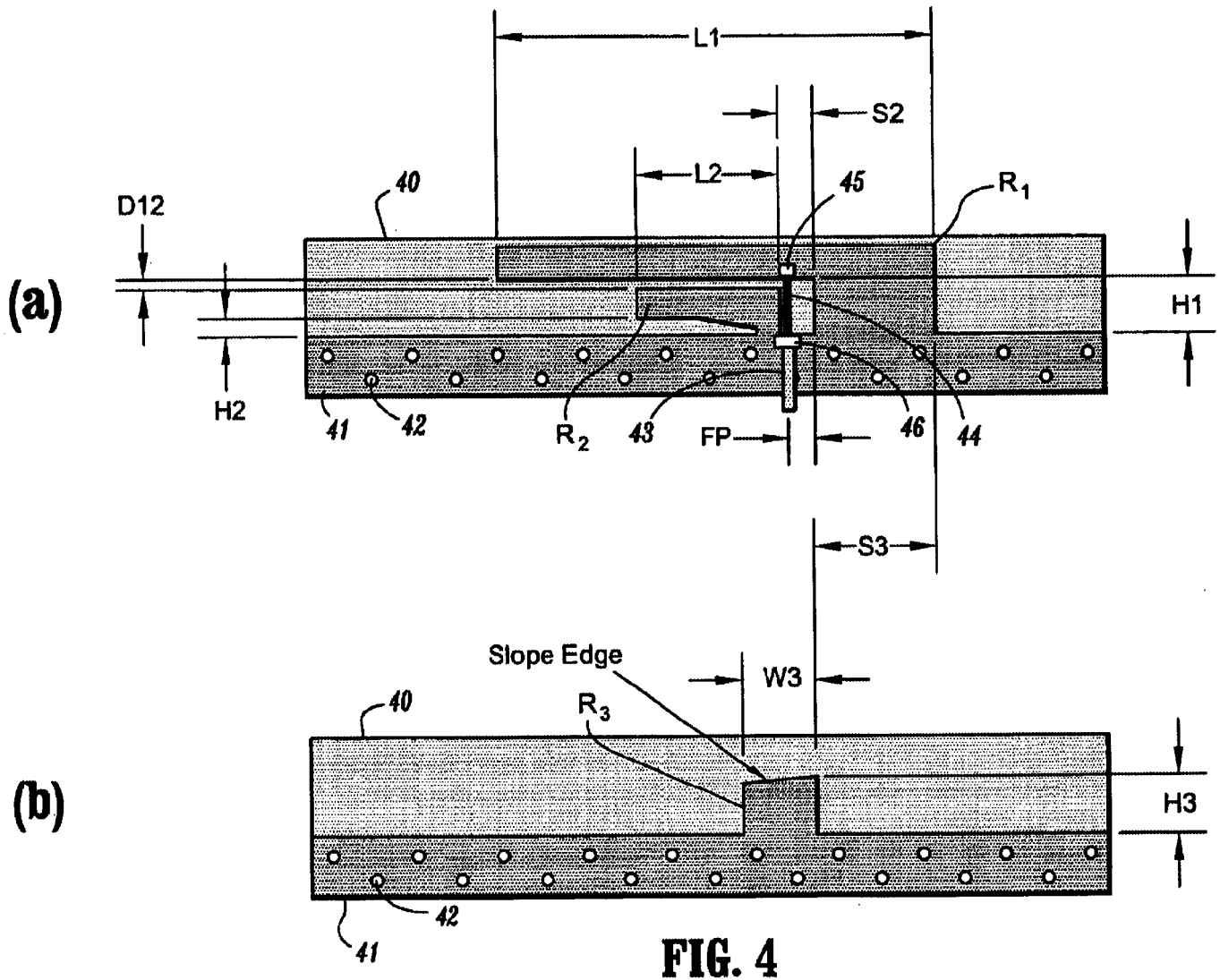
FIGS. 4(*a*) and 4(*b*) are schematic diagrams illustrating a tri-band antenna according to an embodiment of the invention.
Figure 5A:
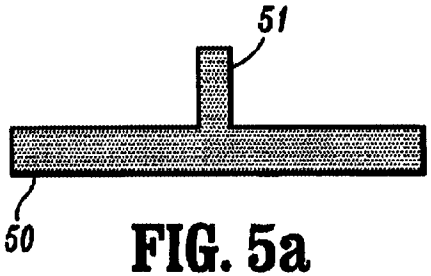
FIGS. 5(*a*)–(*i*) illustrate various antenna elements that may be used for constructing a tri-band antenna according to the invention.
Figure 5B:
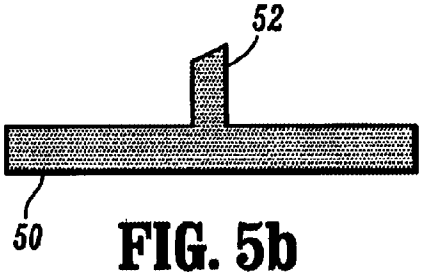
Figure 5C:
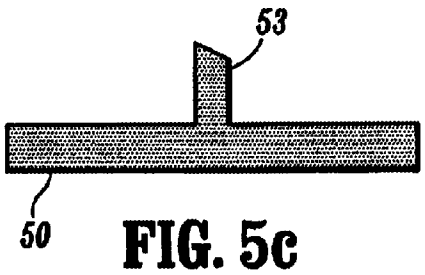
Figure 5D:
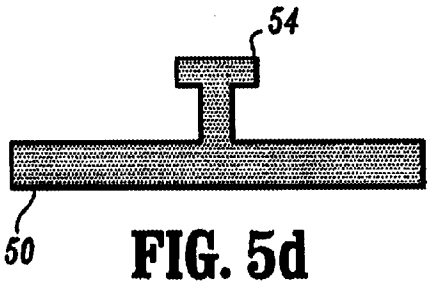
Figure 5E:
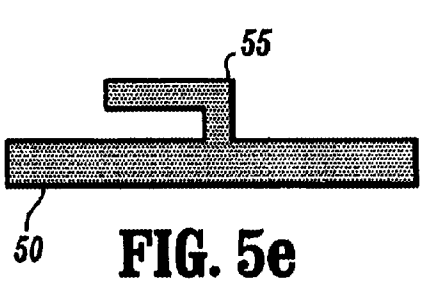
Figure 5F:
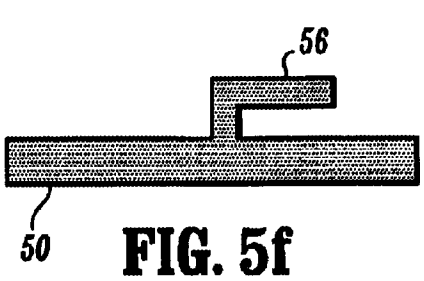
Figure 5G:
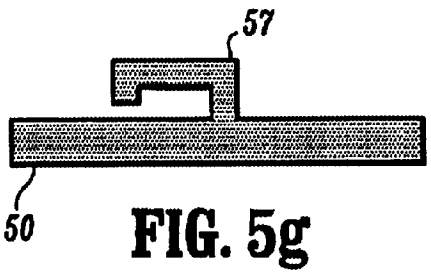
Figure 5H:
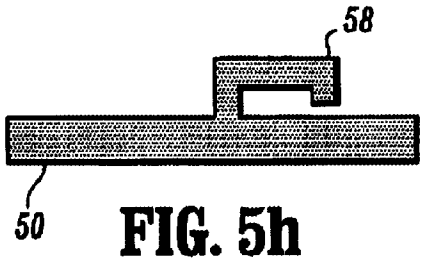
Figure 5I:
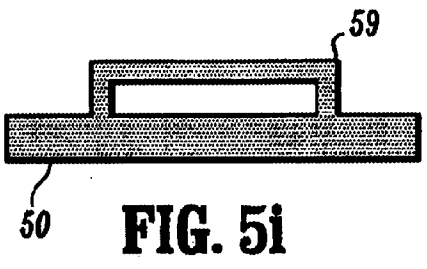

FIG. 4 illustrates a tri-band antenna according to one embodiment of the invention. More specifically, FIG. 4 illustrates a tri-band antenna framework of FIG. 3(*c*), wherein the antenna elements comprise metallic strips formed on a substrate (e.g. copper strips formed on a double-sided PCB (printed circuit board)). FIG. 4*a* illustrates a front side of a PCB wherein elements R1 and R2 are formed on one side of a substrate (40) and FIG. 4*b* illustrates the backside of the PCB wherein element R3 is formed on the other side of the substrate (40). The antenna elements R1, R2, and R3 are sized, shaped and positioned relative to each other, in such a manner that provides reliable tri-band operation, for example.

Each side of the PCB substrate (40) comprises a ground strip (41). The ground strips (41) are connected via a plurality of plated through holes (42) that are formed through the substrate (40). The antenna is fed by, e.g., a coaxial cable 43, wherein a center conductor (44) is electrically connected to element R1 via a solder connection (45). In addition, the outer conductor (ground) of the coaxial cable (43) is electrically connected to the ground strip (41) via a solder connection (46).

In one embodiment, elements R1 and R2 formed on the front side of the tri-band antenna (FIG. 4*a*) are configured to operate, respectively, in a low frequency band (e.g., 2.4 GHz2.5 GHz) and a middle frequency band (e.g., 5.15 GHz–5.35 GHz). In the illustrative embodiment of FIG. 4(*a*), the elements R1 and R2 comprise an inverted-F dual-band antenna, although it is to be appreciated that elements R1 and R2 may comprise any dual-band antenna framework such as disclosed in the above-incorporated U.S. Ser. No. 09/866,974. The element R3 formed on the backside of the PCB substrate (40) (FIG. 4*b*) is configured to operate in the high frequency band (e.g., 5.47 GHz–5.825 GHz).

In the exemplary embodiment of FIG. 4, for element R1, the resonant frequency of the low frequency band is determined primarily by the total length of about L1+H1. The bandwidth of the tri-band antenna at the lower band can be widened by increasing H1 and the width of the metal strips that form element R1 (i.e., the horizontal and vertical sections). The impedance of the antenna can be changed by moving the feed point (FP). More specifically, moving the FP to the left (open) side will increase the impedance and moving the FP to the right (grounded) side will reduce the impedance. The FP location will have some effect on the resonating frequency. With the antenna framework of FIG. 4, the middle and high band elements (R2, R3) have negligible effect on the lower band (R1).

For element R2, the middle band frequency is determined by the total length of about H2+L2. The impedance in the middle band is primarily determined by the coupling distances D12, S2 and S2-FP between elements R1 and R2. In general, reducing D12 and S2 will increase the coupling and, consequently, increase the impedance in the corresponding band. Widening the width of element R2 will broaden the impedance bandwidth. Further, it has been determined that tapering the inner corner of element R2 as shown in FIG. 4(*a*), for example, provides improvement in the bandwidth. In addition, adjusting S2-FP also changes the matching and frequency.

For element R3, the high band is determined by the distances H3, S3 and W3. The distance H3 is a primary factor for adjusting the resonating frequency. The distance S3 changes the coupling between the high band and the lower band. The coupling of the high band (element R3) is further determined by parameters such as the thickness and dielectric constant of the PCB substrate (40). Further, experiments have indicated that a sloped top edge of element R3 improves impedance matching and widens the bandwidth.

As mentioned above, the middle and high bands can be exchanged. For instance, element R2 can be sized and shaped to provide a resonant frequency in a high band and element R3 can be sized and shaped to provide a resonant frequency in the middle band. Those of ordinary skill in the art will readily appreciate that the size, shape, and/or positioning of the various elements R1, R2 and R3 of a tri-band antenna according to the invention will vary depending on factors such as the antenna environment, the available space for the antenna, and the relative frequency bands when used for different applications.

As noted above, FIG. 4 is one embodiment of a tri-band antenna framework as shown in FIG. 3(*c*), wherein the tri-band antenna (30) is formed from a dual-sided PCB (printed circuit board) having elements R1, R2 and R3 printed on opposite sides of the PCB substrate. It is to be understood, however, that the tri-band antenna (30) can be built using other methods. For instance, the tri-band antenna (30) may be formed from stamped sheet metal, wherein the front-side and back-side elements and grounding strip are stamped from a planar sheet of metal and wherein the resulting structure is then folded along a folding line in the ground strip such that element R3 is disposed next to elements R1 and R2, with an air space in between. In addition, for laptops with displays having metallic covers, the elements R1, R2 and R3 can be formed as part of the metallic cover or elements R1 and R2 can be formed as part of the metallic cover, with element R3 being separately formed and positioned appropriately in relation to elements R1 and R2. In another embodiment, for laptops comprising displays having RF shielding foil, the elements R1 and R2 may be formed on the foil with element R3 being separately formed and positioned appropriately in relation to elements R1 and R2. Based on the teachings herein, those of ordinary skill in the art can readily envision other methods for constructing a tri-band antenna according to the invention.

It is to be appreciated that a tri-band antenna according to the invention can be designed to operate in various frequency bands. Further, although the antenna of FIG. 4 is preferably used for tri-band applications, the antenna design can be used for dual-band applications where the high band has a wide frequency span (see, e.g., FIG. 10 below).

FIG. 5 illustrates various antenna elements that may be used in the tri-band antenna of FIG. 4. For instance, depending on the application, elements R2 and R3 shown in FIG. 4 may be any of the structures shown in FIGS. 5(*a*)–5(*i*) (wherein element (50) denotes a ground strip). Further, element R1 may be any of the structures shown in FIG. 5(*g*)–(*i*). More specifically, elements (51), (52) and (53) may be used as element R3 as shown in FIG. 4(*b*) (or element R2 depending on the design). The element (59) shown in FIG. 5(*i*) comprises a slot antenna. In environments where space is limited, elements (57) and (58) (shown in FIGS. 5(*g*) and 5(*h*)) can be used alternative to elements (55) and (56) (shown in FIGS. 5(*e*) and 5(*f*)). Indeed, the bend on the open end of the elements (57) and (58) provides increased capacitive coupling to ground (50), and consequently, the horizontal length of the elements (57) and (58) can be shorter than the horizontal length of elements (55) and (56). In addition, element (54) in FIG. 5(*d*) can be used as an alternative to element (51) in FIG. 5(*a*) to reduce the height of the element (51).

Figure 6A:
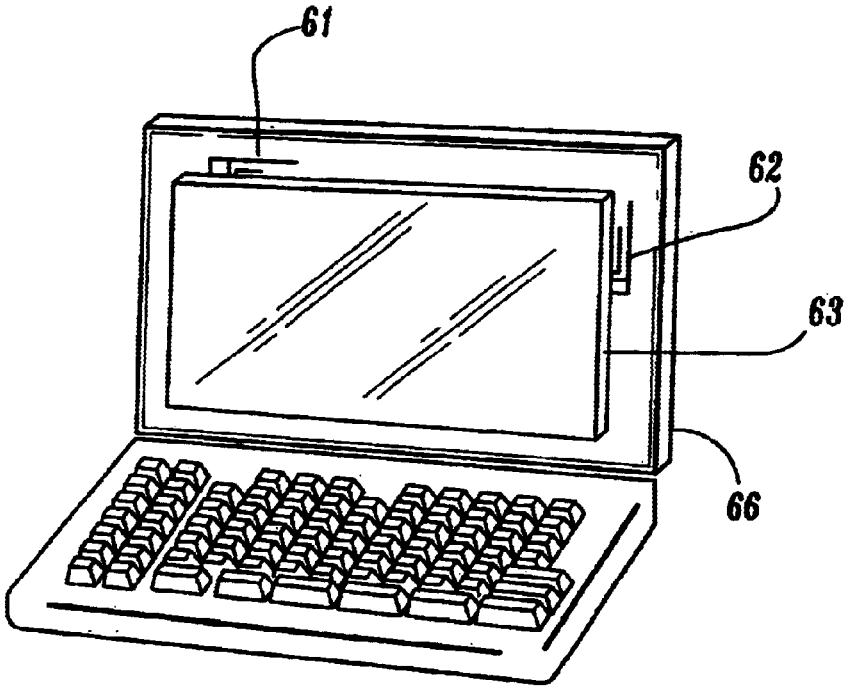
FIGS. 6(*a*) and 6(*b*) are schematic diagrams illustrating various orientations for mounting tri-band antennas on a laptop display unit according to the invention.
Figure 6B:
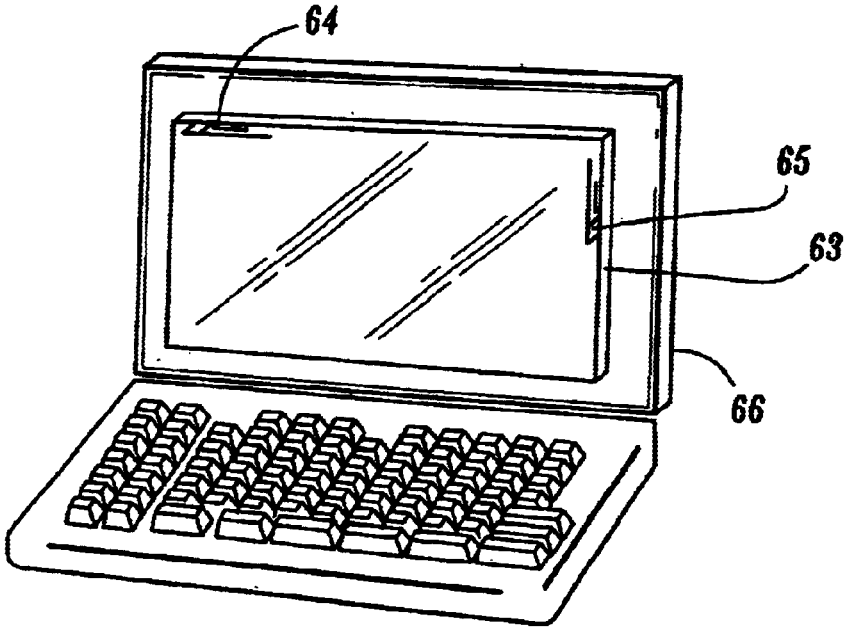

FIGS. 6(*a*) and 6(*b*) are schematic diagrams illustrating various orientations for mounting tri-band antennas on a laptop display unit according to the invention. For instance, FIG. 6(*a*) illustrates two tri-band antennas (61, 62) mounted to a metallic support frame (63) of the laptop display unit having a plastic cover (66), wherein the plane of each tri-band antenna (61, 62) is substantially parallel to the plane of the display frame (63). FIG. 6(*b*) illustrates two tri-band antennas (64, 65) mounted to the display frame (63) wherein the plane of each tri-band antenna (64, 65) is substantially perpendicular to the plane of the display frame (63). In FIGS. 6(*a*) and 6(*b*), the tri-band antennas (62) and (65) can be positioned on the left side of the display frame (63)(as opposed to the right side of the frame as shown) and the tri-band antennas (61) and (64) can be located on the right side of the upper portion of the frame (63) (as opposed to the left side of the upper portion of the frame as shown). In the exemplary embodiments, the tri-band antennas are connected to the display frame (63) of the laptop display to ground the tri-band antennas. The metal support frame and/or RF shielding foil on the back of the display unit can be part of the tri-band antenna as discussed above. The parallel antennas (FIG. 6(*a*)) or perpendicular antennas (FIG. 6(*b*)) may be implemented depending on the industrial design needs and both implementations provide similar performances. Further, the various antennas may be implemented together, for example, using the different structures shown in FIG. 5. For example, a parallel inverted-F antenna and a perpendicular slot antenna may be mounted on the same device.

Figure 7A:
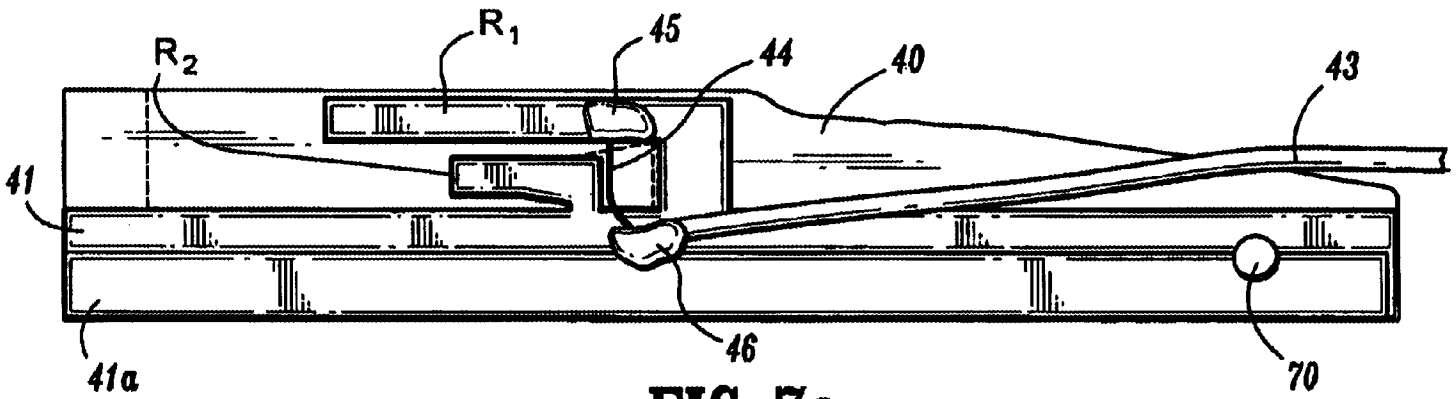
FIGS. 7(*a*) and 7(*b*) are diagrams illustrating an actual tri-band antenna implementation according to an embodiment of the invention based on the antenna framework shown in FIG. 4.
Figure 7B:
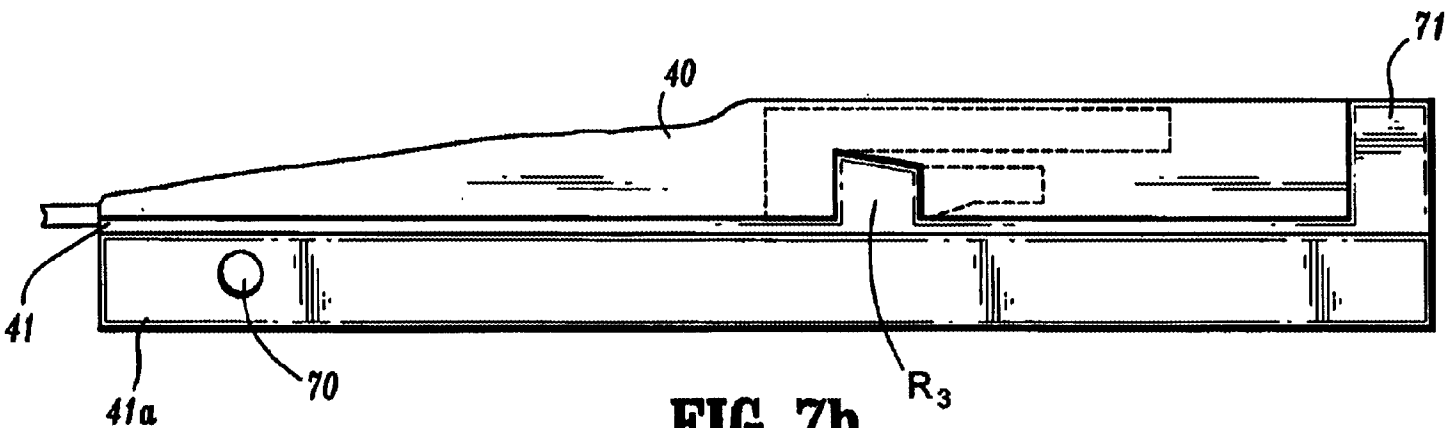

FIGS. 7(*a*) and 7(*b*) are diagrams illustrating an actual tri-band antenna implementation according to an embodiment of the invention based on the antenna framework shown in FIG. 4. The tri-band antenna is fabricated on a 0.014" thick GETEK PCB. The GETEK PCB substrate has 3.98 dielectric constant and 0.014 loss tangent measured from 0.3 GHz to 6 GHz. The prototype tri-band antenna shown in FIG. 7 was built for use with an IBM ThinkPad laptop computer having a metallic display cover.

FIG. 7(*a*) is similar to FIG. 4(*a*) and illustrates a front view of the tri-band antenna comprising low band and middle band elements R1 and R2. FIG. 7(*b*) is similar to FIG. 4(*b*) and illustrates a back view of the tri-band antenna comprising high band element R3. Element (71) is part of the grounding strip (41) and in the particular application where the display cover is metal (no metal RF foil for RF shielding), element (71) provides a large contact surface for contacting the metal cover to provide sufficient grounding.

In FIG. 7, the ground strips on both sides of the PCB are connected by copper tape 41*a* (as opposed to plated through holes shown in FIG. 4). One or more mounting holes (70) are used for mounting the antenna to a laptop display frame with a metal screw (which grounds the antenna). In the implementation, both ground plane surfaces are in good contact with the display metal frame and hinge support.

Figure 8:
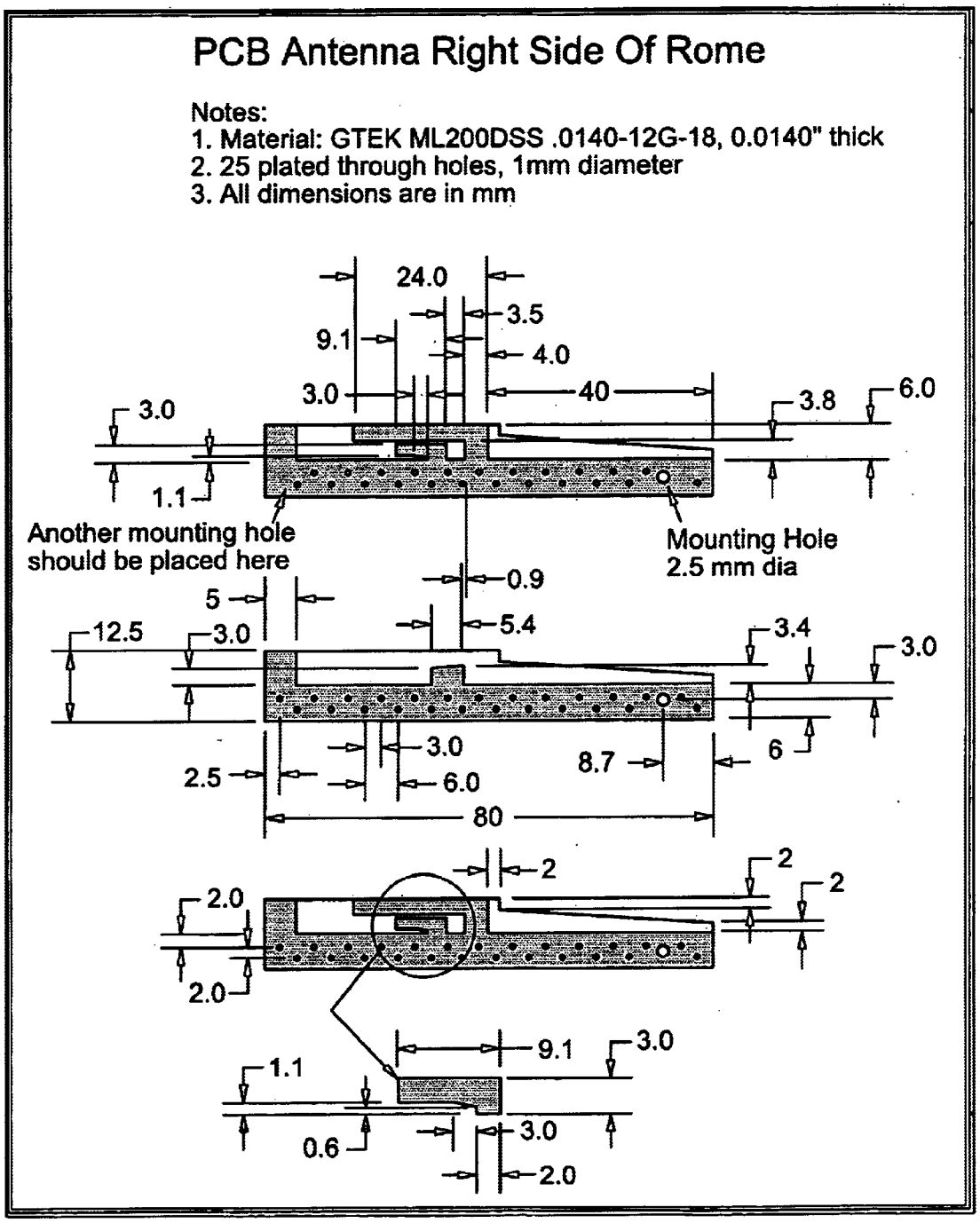
FIG. 8 illustrates structural dimensions of the tri-band antenna of FIG. 7 according to an embodiment of the invention.

FIG. 8 illustrates structural dimensions (in millimeters) of the tri-band antenna of FIG. 7 (and FIG. 4) according to an embodiment of the invention. For instance, based on the parameters shown in FIG. 4, L1 is about 24 mm, H1 is about 6 mm, L2 is about 9.1 mm, S2 is about 3.5 mm, D12 is about 0.8 mm, H2 is about 1.1 mm, S3 is about 4 mm, W3 is about 5.4 mm, and H3 is about 3.4 mm (at the high end, but about 3 mm at the lower sloped end).

It is to be understood that the dimensions shown in FIG. 8 are just one exemplary embodiment of a tri-band antenna according to the invention and that the antenna dimensions are application dependent. Indeed, the dimensions of the antenna will vary depending on factors such as the dielectric constant and thickness of the PCB material, the type of material that covers the antenna and the mounting environment. For instance, if the display provides a large ground surface area or plane, the antenna ground elements can be very small. Further, the antenna dimensions will vary depending on the dielectric constant of a plastic display cover. One of ordinary skill in the art would be able to readily envision such variations based on the teachings herein.

SWR (standing wave ratio) and radiation measurements were performed using a tri-band antenna having the structure and dimensions of FIGS. 7 and 8 as mounted inside a prototype IBM ThinkPad laptop. In particular, such measurements were taken using a single tri-band antenna mounted perpendicular to the ThinkPad display (see, e.g., FIG. 6(*b*)) on the upper left side of the display frame, with the tri-band antenna being connected to the display frame via one or more mounting screws. The results of such measurements are shown in FIG. 9–14.

Figure 9:
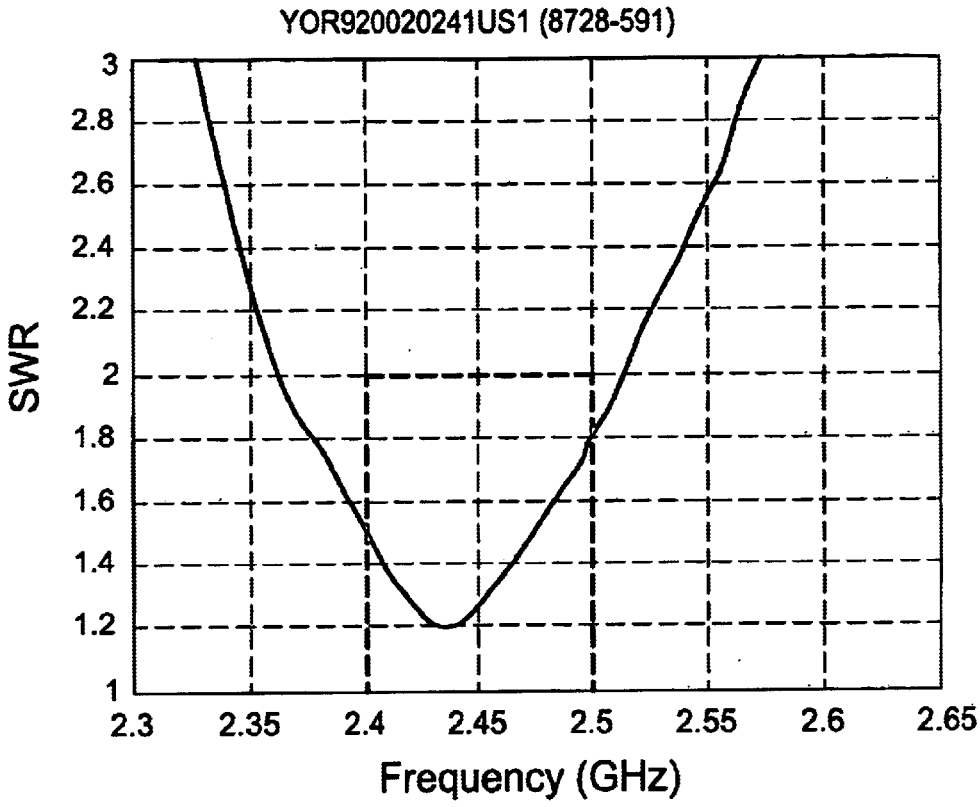
FIG. 9 illustrates the measured SWR (standing wave ratio) of the tri-band antenna of FIG. 7 (as mounted in a laptop display) as a function of frequency in one frequency band.
Figure 10:
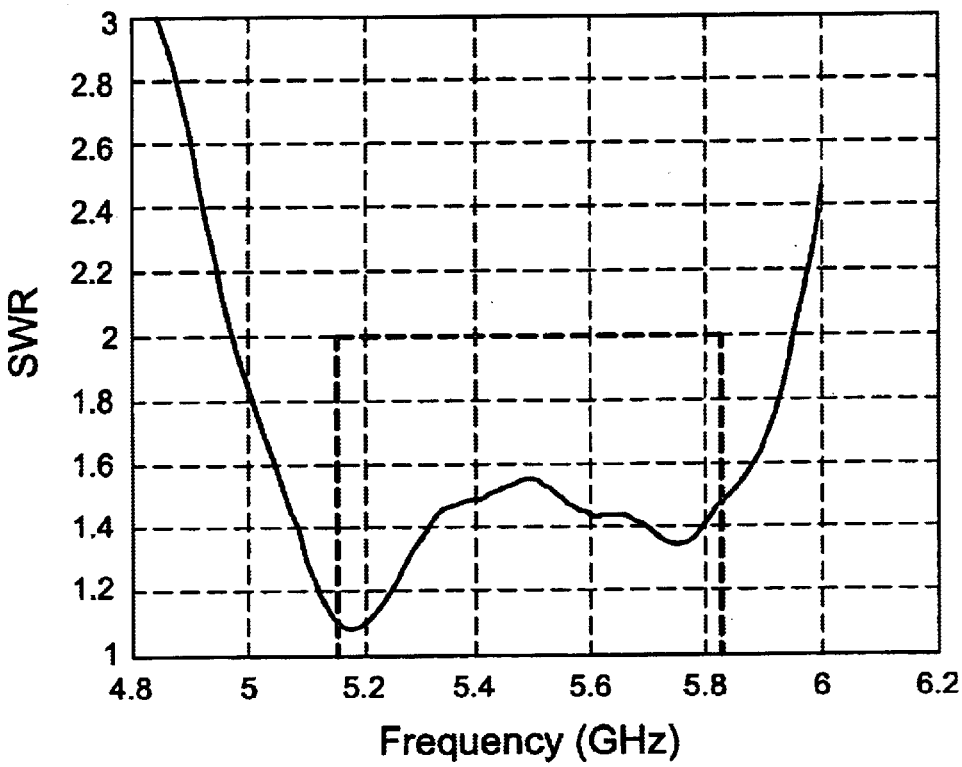
FIG. 10 illustrates the measured SWR (standing wave ratio) of the tri-band antenna of FIG. 7 (as mounted in a laptop display) as a function of frequency in another frequency band.

In particular, FIGS. 9 and 10 show the measured SWR of the tri-band antenna at the 2.4 GHz and 5 GHz bands, respectively. More specifically, as shown in FIG. 9, for the low band, the antenna provides sufficient SWR bandwidth (2:1) in the entire band from 2.4 GHz to 2.5 GHz. Further, as shown in FIG. 11, for the middle and high bands, the antenna provides sufficient SWR bandwidth (2:1) in the entire band from 5.15 GHz to 5.825 GHz.

Figure 13:
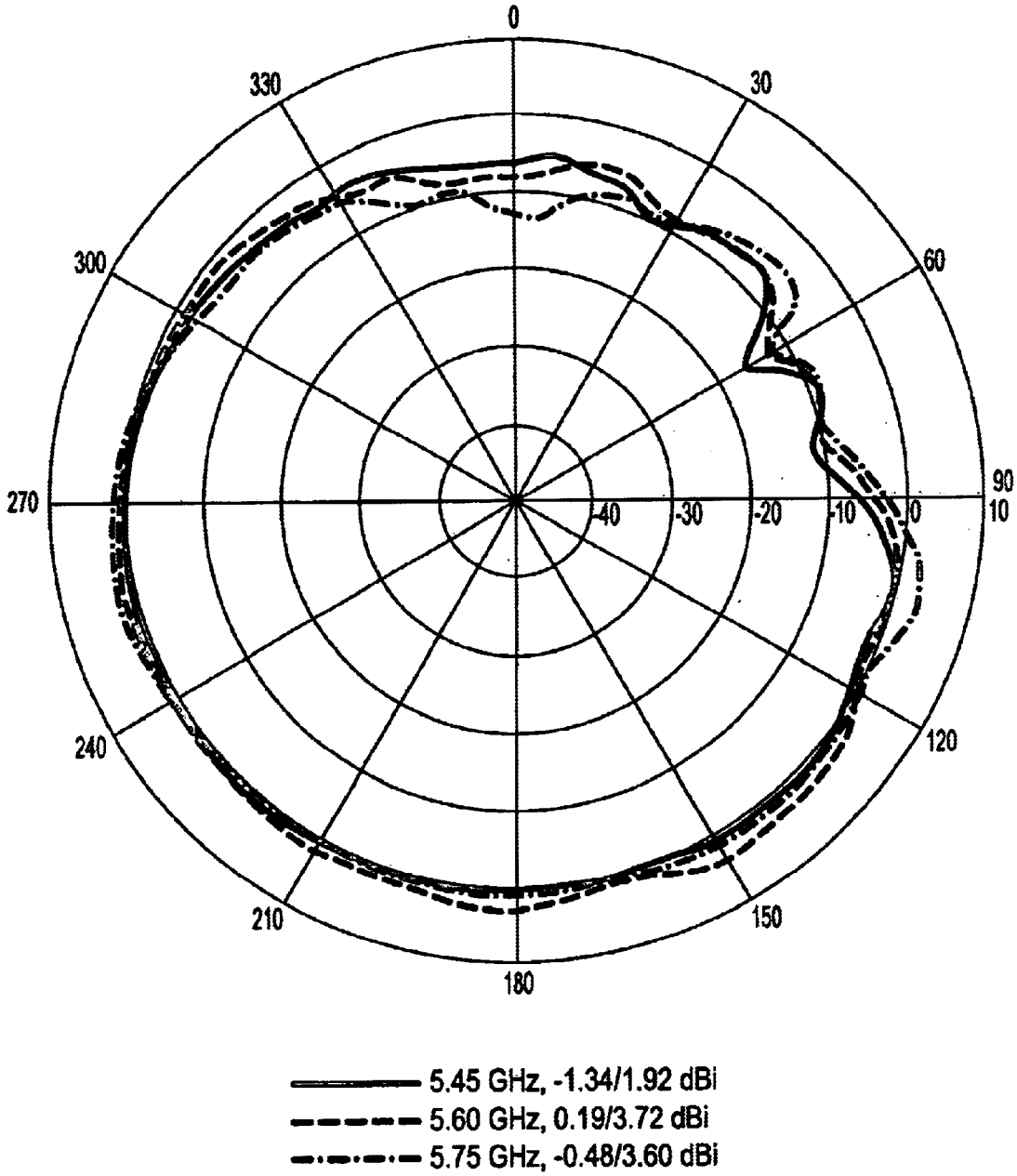
FIG. 13 is a graphical diagram illustrating the measured radiation pattern of the tri-band antenna of FIG. 7 (as mounted in a laptop display) at frequencies of 5.45, 5.6, and 5.75 GHz.
Figure 14:
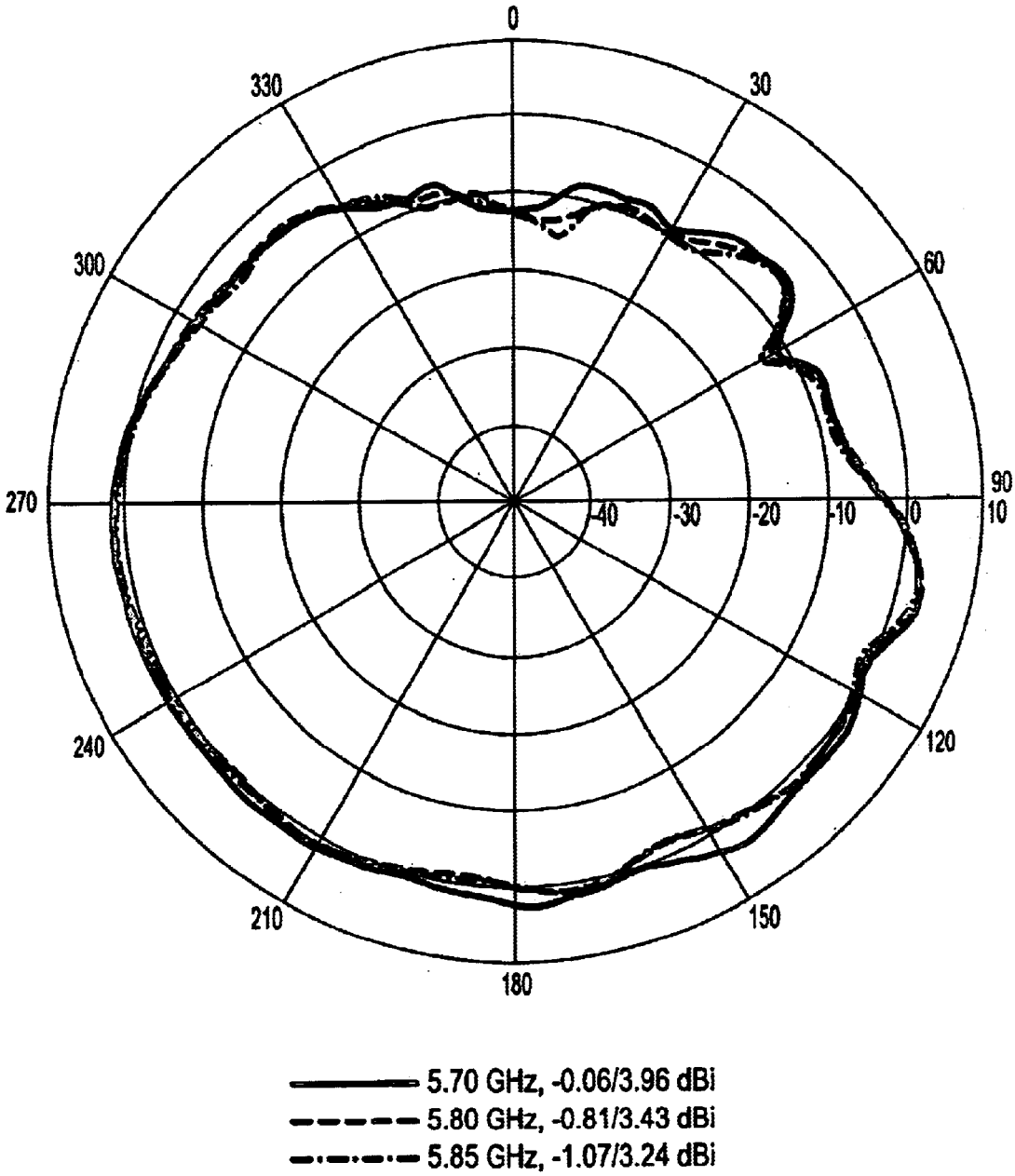
FIG. 14 is a graphical diagram illustrating the measured radiation pattern of the tri-band antenna of FIG. 7 (as mounted in a laptop display) at frequencies of 5.7, 5.8, and 5.85 GHz.
Figure 15:
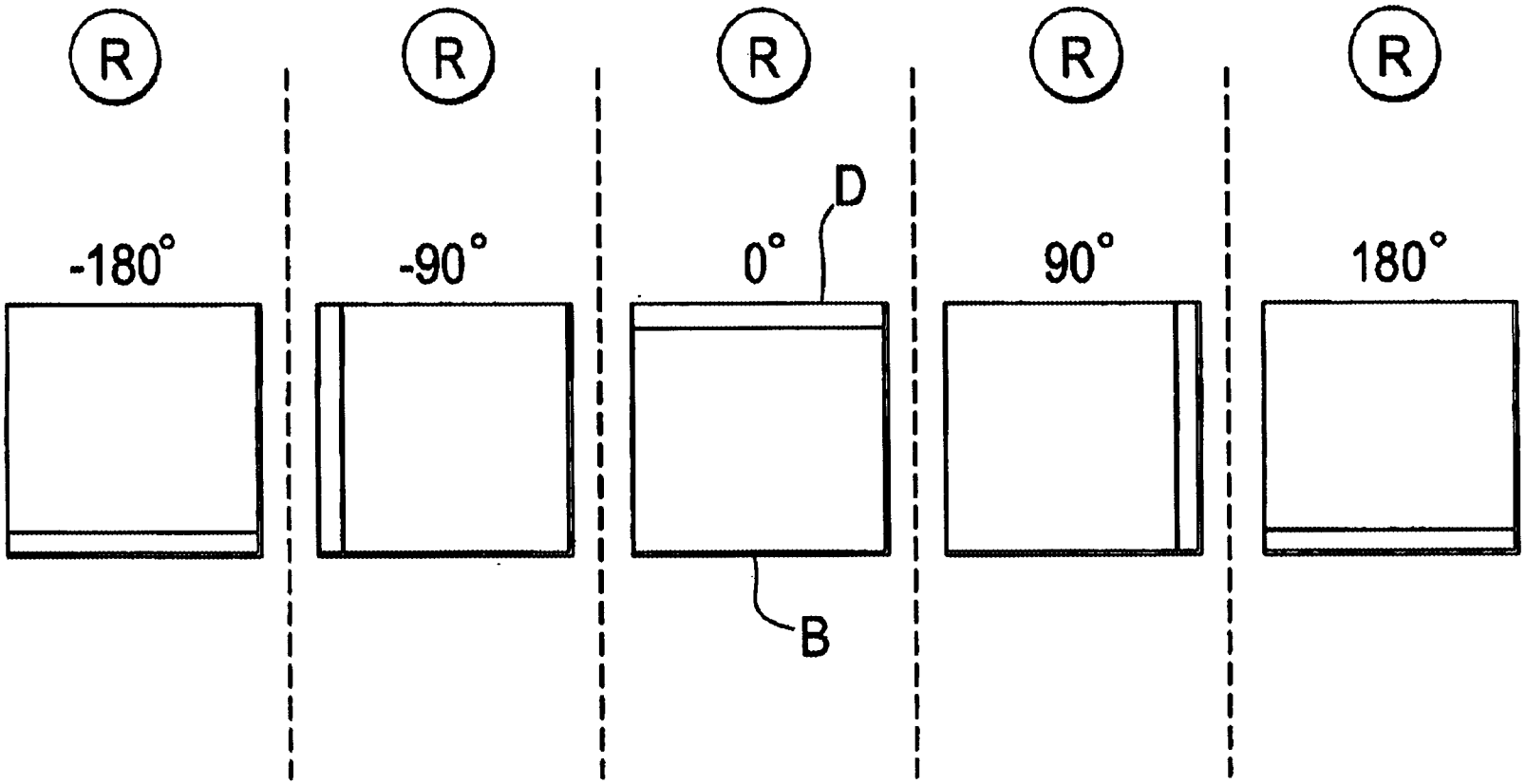
FIG. 15 are top perspective views of various orientations of the laptop (base and display) during the radiation measurements of FIGS. 11–14.

FIGS. 11, 12, 13 and 14 are graphical diagrams illustrating the measured radiation patterns at different frequencies at the 2.4 GHz and 5 GHz bands for orientations of the laptop as shown in FIG. 15. In particular, FIG. 15 illustrates a top view of the laptop orientation during each radiation measurement when the laptop was open and the angle between the display (D) and the base (B) was about 90 degrees. The receiver (R) was positioned as shown at a certain distance from the laptop as the laptop was rotated 360 degrees, with the tri-band antenna transmitting a signal at each of the frequencies in FIGS. 11–14.

Figure 11:
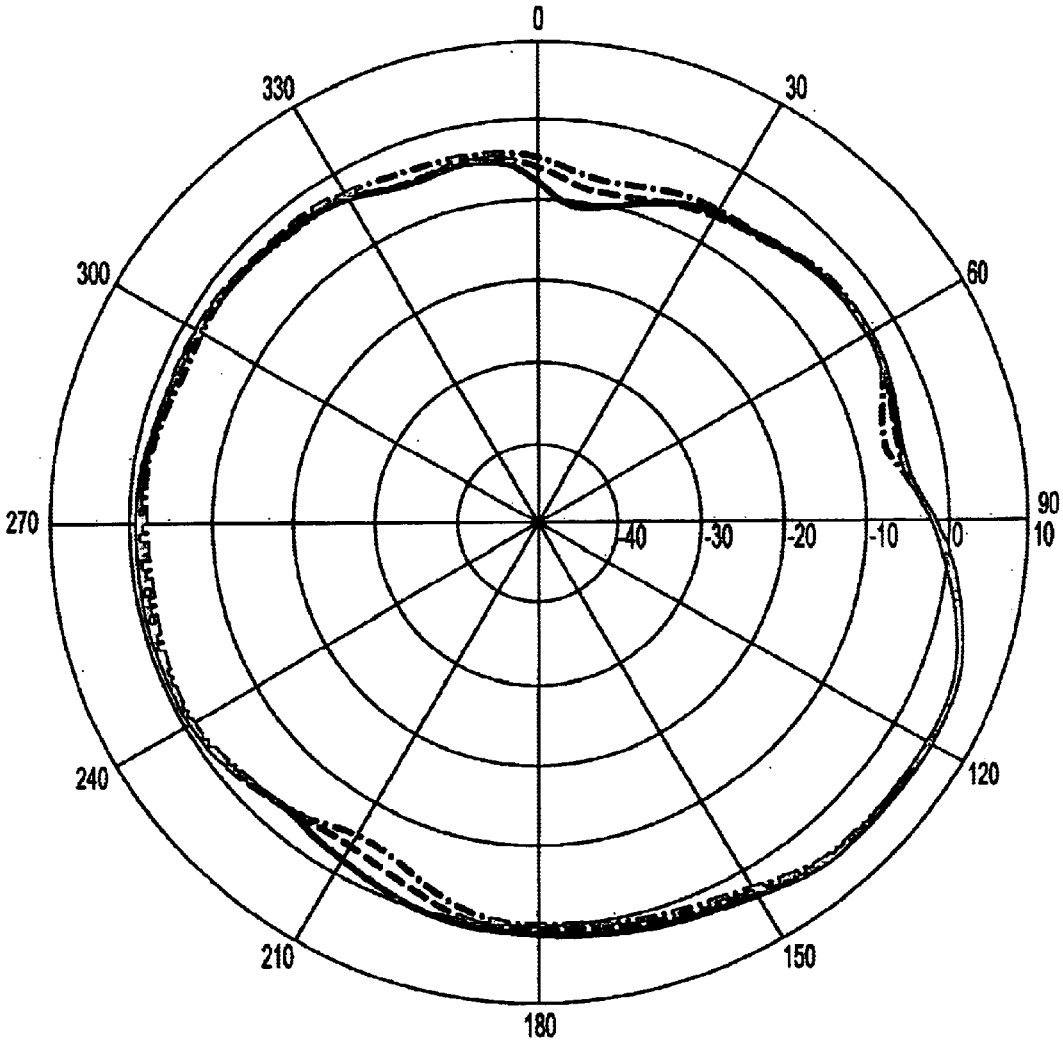
FIG. 11 is a graphical diagram illustrating the measured radiation pattern of the tri-band antenna of FIG. 7 (as mounted in a laptop display) at frequencies of 2.4, 2.45 and 2.5 GHz.
Figure 12:
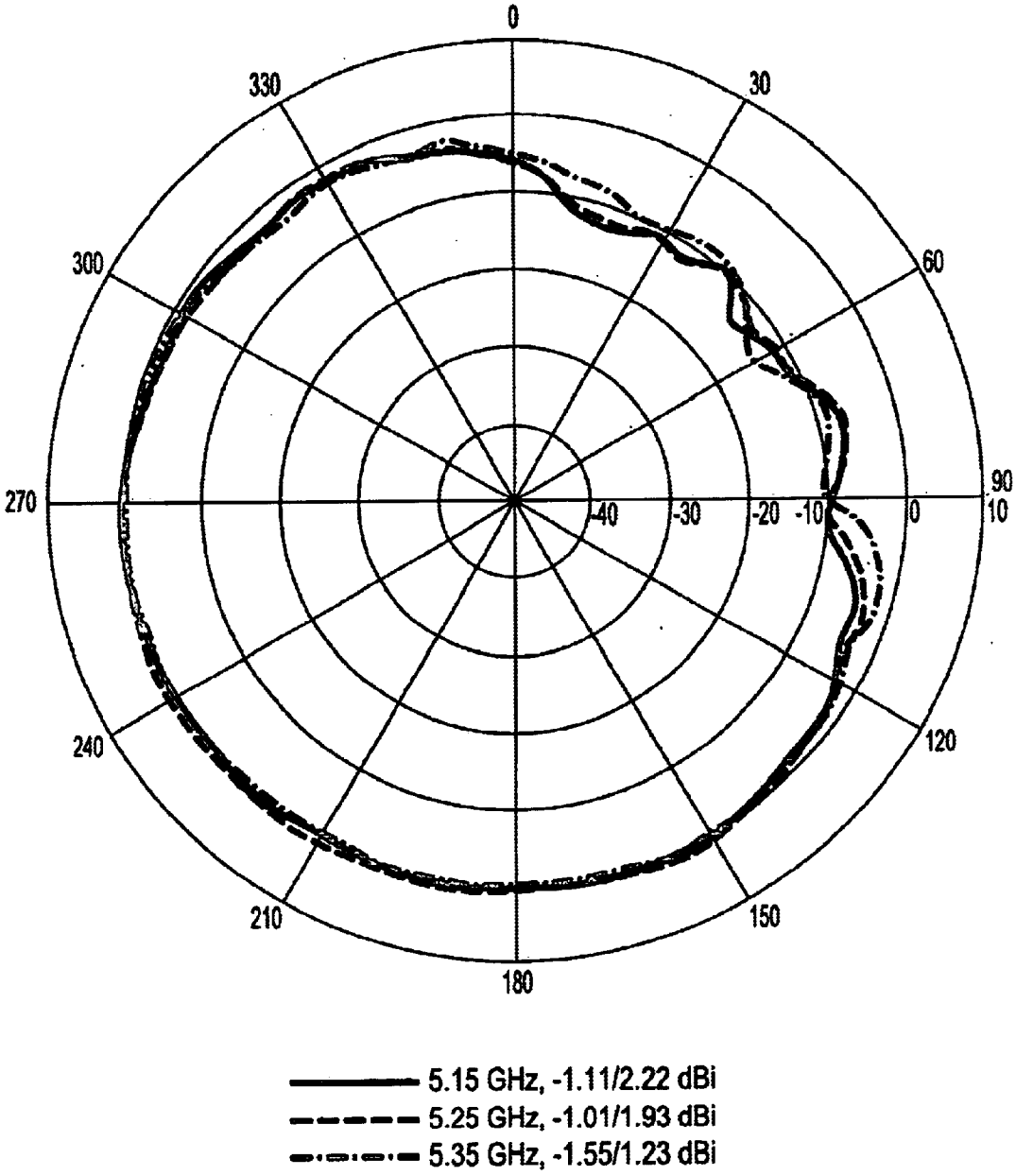
FIG. 12 is a graphical diagram illustrating the measured radiation pattern of the tri-band antenna of FIG. 7 (as mounted in a laptop display) at frequencies of 5.15, 5.25, and 5.35 GHz.

In particular, FIG. 11 illustrates the measured radiation patterns at frequencies of 2.4, 2.45 and 2.5 GHz. FIG. 12 illustrates the measured radiation patterns at frequencies of 5.15, 5.25 and 5.35 GHz. FIG. 13 illustrates the measured radiation patterns at frequencies of 5.45, 5.6 and 5.75 GHz. FIG. 14 illustrates the measured radiation patterns at frequencies of 5.7, 5.8 and 5.85 GHz. Due to the laptop structure, the maximum radiation is about 10 degrees above the horizontal plane. As such, the results presented in FIGS. 11–14 are for the radiation patterns as measured for the azimuth plane 10 degrees above the horizontal plane. The legends show the average/peak gain values at the different frequencies. As shown, the gain values do not change much across the bands. The average gain is about 0 dBi.

Although illustrative embodiments have been described herein with reference to the accompanying drawings, it is to be understood that the present invention is not limited to those precise embodiments, and that various other changes and modifications may be affected therein by one skilled in the art without departing from the scope of the invention.

What is claimed is:

1. A tri-band antenna for a portable device, comprising:

a first element having a resonant frequency in a first frequency band;

a second element having a resonant frequency in a second frequency band; and a third element having a resonant frequency in a third frequency band;

wherein the first element is connected to a signal feed, wherein the second and third elements are grounded, and wherein the tri-band antenna is integrated within the portable device, wherein the first and second elements comprise metal strips formed on a first side of a PCB (printed circuit board) substrate, and wherein the third element comprises a metal strip formed on second side of the PCB substrate.

2. The antenna of claim 1, wherein the first frequency band is about 2.4 GHz to about 2.5 GHz, wherein the second frequency band is about 5.15 GHz to about 5.35 GHz and wherein the third frequency band is about 5.47 GHz to about 5.825 GHz.

3. The antenna of claim 1, wherein the first element is connected to ground.

4. The antenna of claim 1, wherein the first element is one of an inverted-F antenna and a slot antenna.

5. The antenna of claim 1, wherein the second element is one of an inverted-L antenna and a slot antenna.

6. The antenna of claim 1, wherein the signal feed comprises a coaxial transmission line having a center conductor connected to the first element.

7. The antenna of claim 1, wherein the portable device comprises a portable computer comprising a display unit with a metal support frame, and wherein the PCB is mounted to the metal support frame of the display unit.

8. The antenna of claim 7, wherein a plane of the antenna is disposed substantially parallel to a plane of the metal support frame.

9. The antenna of claim 7, wherein a plane of the antenna is disposed substantially perpendicular to a plane of the metal support frame.

10. A tri-band antenna for a portable device, wherein the portable device comprises a signal feed and a display unit having a metallic support frame, the tri-band antenna comprising:

a first element having a resonant frequency in a first frequency band;

a second element having a resonant frequency in a second frequency band;

a third element having a resonant frequency in a third frequency band; and a ground element for grounding one of the first element, the second element, the third element and any combination thereof, wherein the first, second and third elements and ground element comprise metallic elements formed on a PCB (printed circuit board), wherein the first element is connected to the signal feed, and wherein the PCB is mounted to the metallic support frame of the display unit.

11. The antenna of claim 10, wherein the portable device is a portable computer.

12. The antenna of claim 10, wherein the first frequency band is about 2.4 GHz to about 2.5 GHz, wherein the second frequency band is about 5.15 GHz to about 5.35 GHz and wherein the third frequency band is about 5.47 GHz to about 5.825 GHz.

13. The antenna of claim 10, wherein the first element is one of an inverted-F antenna and a slot antenna.

14. The antenna of claim 10, wherein the second element is one of an inverted-L antenna and a slot antenna.

15. The antenna of claim 10, wherein the third element is tab-shaped.

16. The antenna of claim 15, wherein the third element has a sloped edge.

17. The antenna of claim 10, wherein the first and second elements are formed on a first side of the PCB and wherein the third element is formed on a second side of the PCB.

18. The antenna of claim 10, wherein the signal feed comprises a coaxial transmission line having a center conductor connected to the first element and an outer conductor connected to the ground element.

19. The antenna of claim 10, wherein a plane of the PCB is disposed substantially parallel to a plane of the metallic support frame.

20. The antenna of claim 10, wherein a plane of the PCB is disposed substantially perpendicular to a plane of the metallic support frame.

21. A tri-band antenna for a portable computer having a display unit, the tri-band antenna comprising:

a first element having a resonant frequency in a first frequency band;

a second element having a resonant frequency in a second frequency band;

a third element having a resonant frequency in a third frequency band; and a ground element for grounding one of the first element, the second element, the third element and any combination thereof, wherein the first, second, and third elements comprise planar metal strips, and wherein the third element is oriented in a first plane that is adjacent to, and separated by a predetermined coupling distance from, a second plane comprising the first and second elements, wherein the first, second and third elements are integrally formed from a stamped portion of a metal sheet, and wherein the first, second and third elements are integrally formed within the display unit of the portable computer.

22. The antenna of claim 21, wherein the first frequency band is about 2.4 GHz to about 2.5 GHz, wherein the second frequency band is about 5.15 GHz to about 5.35 GHz and wherein the third frequency band is about 5.47 GHz to about 5.825 GHz.

23. The antenna of claim 21, wherein the first element is one of an inverted-F antenna and a slot antenna.

24. The antenna of claim 21, wherein the second element is one of an inverted-L antenna and a slot antenna.

25. The antenna of claim 21, wherein the first element is connected to a signal feed, wherein the signal feed comprises a coaxial transmission line having a center conductor connected to the first element.

* * * * *